US011655091B2

(12) United States Patent
Ma et al.

(10) Patent No.: US 11,655,091 B2
(45) Date of Patent: May 23, 2023

(54) FLEXIBLE CONTAINER WITH TETHER

(71) Applicant: Dow Global Technologies LLC, Midland, MI (US)

(72) Inventors: Liangkai Ma, Midland, MI (US); Marc S. Black, Midland, MI (US); Chad V. Schuette, Saginaw, MI (US); Brian W. Walther, Clute, TX (US); Fabrice Digonnet, Faellanden (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 17/614,849

(22) PCT Filed: May 28, 2020

(86) PCT No.: PCT/US2020/034790

§ 371 (c)(1),
(2) Date: Nov. 29, 2021

(87) PCT Pub. No.: WO2020/243221

PCT Pub. Date: Dec. 3, 2020

(65) Prior Publication Data

US 2022/0227558 A1 Jul. 21, 2022

Related U.S. Application Data

(60) Provisional application No. 62/855,366, filed on May 31, 2019.

(51) Int. Cl.

| | |
|---|---|
| ***B65D 75/58*** | (2006.01) |
| ***B65D 33/06*** | (2006.01) |
| *B65D 75/56* | (2006.01) |

(52) U.S. Cl.
CPC ..... *B65D 75/5883* (2013.01); *B65D 33/06* (2013.01); *B65D 75/566* (2013.01)

(58) Field of Classification Search
CPC ... B65D 75/5883; B65D 33/06; B65D 75/566
(Continued)

(56) References Cited

U.S. PATENT DOCUMENTS 3,554,256 A * 1/1971 Anderson ..... A61J 1/10 604/416

5,783,638 A 7/1998 Lai et al.

(Continued)

FOREIGN PATENT DOCUMENTS

JP 2004-168341 A 6/2004

*Primary Examiner* — Jes F Pascua

(74) *Attorney, Agent, or Firm* — Quarles & Brady LLP

(57) ABSTRACT

The present disclosure provides a flexible container (10). In an embodiment, the flexible container includes: a front panel (22), a rear panel (24), a first gusseted side panel (18), and a second gusseted side panel (20). The gusseted side panels adjoin the front panel and the rear panel along peripheral seals (41) to form (i) a top portion, (ii) a body portion, and (iii) a bottom portion. The top portion comprises a neck (27) and a fitment (30) in the neck. The top portion comprises a top handle (12) extending above the fitment, the top handle having a reciprocal attachment member (5). The bottom portion comprises a bottom handle (14) and a tether (6) extending from the bottom handle. A distal end of the tether has an attachment member (7), the attachment member adapted to secure to the reciprocal attachment member.

9 Claims, 4 Drawing Sheets

(58) Field of Classification Search
USPC ..... 383/200
See application file for complete search history.

(56) References Cited

U.S. PATENT DOCUMENTS

| | | | | |
|---|---|---|---|---|
| 5,863,131 | A * | 1/1999 | Nakamura | B65D 75/5883 383/906 |
| 11,155,394 | B2 | 10/2021 | Black et al. | |
| 11,198,550 | B2 | 12/2021 | Black et al. | |
| 2009/0162133 | A1 | 6/2009 | Haefele et al. | |
| 2011/0069908 | A1 | 3/2011 | Wilkes et al. | |
| 2013/0121622 | A1 | 5/2013 | Wilkes et al. | |
| 2014/0112599 | A1 | 4/2014 | Martin et al. | |
| 2015/0314928 | A1 | 11/2015 | Wilkes et al. | |
| 2017/0197771 | A1 | 7/2017 | Smith | |

* cited by examiner

FLEXIBLE CONTAINER WITH TETHER

BACKGROUND

Known are flexible containers that are used to store, transport, and dispense a flowable material. Large, gusseted flexible containers having handles on the top and the bottom of the container are becoming increasingly available. The requisite two-hand operation of the dual handle container has several drawbacks. The non-rigid and pliable nature of the flexible container requires two-hand operation to avoid spillage while dispensing. The operator's care and attention is further required during the entire dispensing sequence to ensure the container handle does not get in the way of the dispensing flow and invoke spillage.

The art recognizes the need for flexible containers with improved handling and dispensing control.

SUMMARY

Disclosed herein is a flexible container. In an embodiment, the flexible container includes a front panel, a rear panel, a first gusseted side panel, and a second gusseted side panel. The gusseted side panels adjoin the front panel and the rear panel along peripheral seals to form (i) a top portion, (ii) a body portion, and (iii) a bottom portion. The top portion comprises a neck and a fitment in the neck. The top portion comprises a top handle extending above the fitment, the top handle having a reciprocal attachment member. The bottom portion comprises a bottom handle and a tether extending from the bottom handle. A distal end of the tether has an attachment member, the attachment member adapted to secure to the reciprocal attachment member.

Also disclosed herein is a process. In an embodiment, the process includes providing a flexible container comprising a front panel, a rear panel, a first gusseted side panel, and a second gusseted side panel. The gusseted side panels adjoin the front panel and the rear panel along peripheral seals to form (i) a top portion, (ii) a body portion, and (iii) a bottom portion. The top portion comprises a neck and a fitment in the neck. The top portion comprises a top handle extending above the fitment, the top handle having a reciprocal attachment member. The bottom portion comprises a bottom handle and a tether extending from the bottom handle. A distal end of the tether has an attachment member, the attachment member adapted to secure to the reciprocal attachment member. The process includes securing the attachment member to the reciprocal attachment member.

DEFINITIONS

Figure 1:
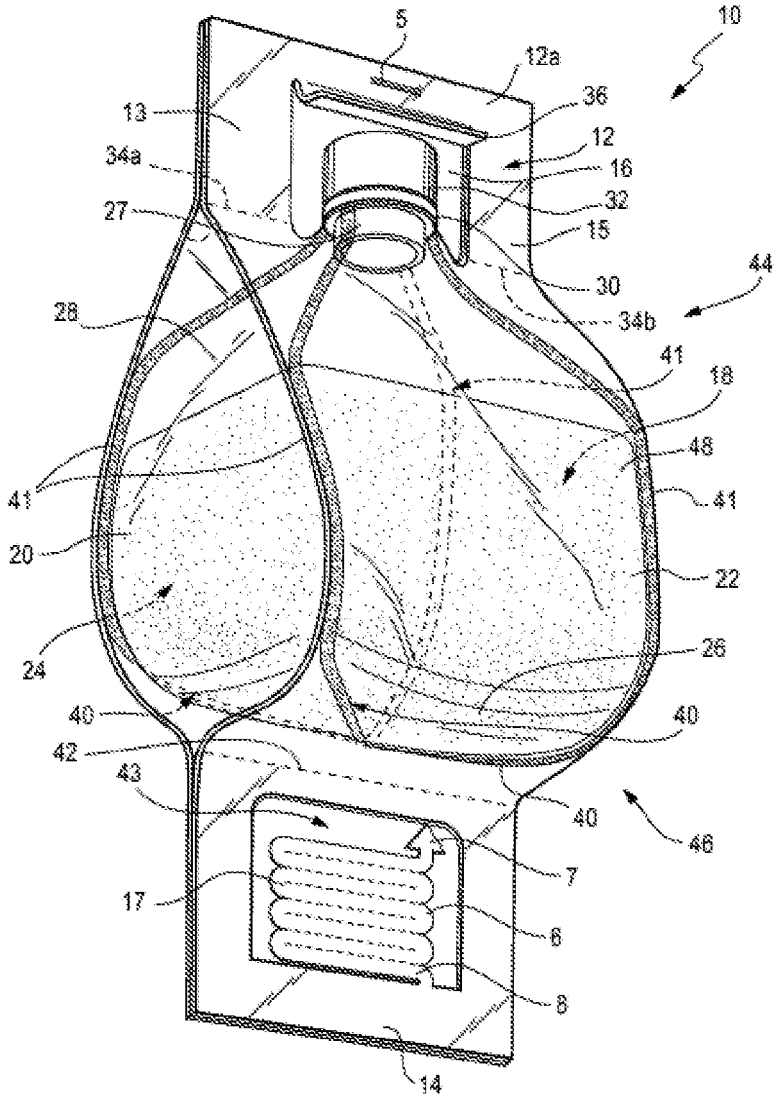
FIG. 1 is a perspective view of a flexible container with a stowed tether in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Group or Groups reflected in this Periodic Table of the Elements using the IUPAC system for numbering groups.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges disclosed herein include all values from, and including, the lower value and the upper value. For ranges containing explicit values (e.g., a range from 1, or 2, or 3 to 5, or 6, or 7) any subrange between any two explicit values is included (e.g., the range 1-7 above includes subranges 1 to 2; 2 to 6; 5 to 7; 3 to 7; 5 to 6; etc.).

Unless stated to the contrary, implicit from the context, or customary in the art, all parts and percentages are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

An "ethylene-based polymer," as used herein is a polymer that contains more than 50 weight percent polymerized ethylene monomer (based on the total amount of polymerizable monomers) and, optionally, may contain at least one comonomer.

An "olefin-based polymer," as used herein is a polymer that contains more than 50 weight percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 weight percent polymerized propylene monomer (based on the total amount of polymerizable monomers) and, optionally, may contain at least one comonomer.

TEST METHODS

Density is measured in accordance with ASTM D792 with results reported in grams per cubic centimeter (g/cc).

Melt index (MI) is measured in accordance with ASTM D1238, Condition 190° C./2.16 kg with results reported in grams per 10 minutes (g/10 min). Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

DETAILED DESCRIPTION

The present disclosure provides a flexible container. The flexible container includes a front panel, a rear panel, a first gusseted side panel, and a second gusseted side panel. The gusseted side panels adjoin the front panel and the rear panel along peripheral seals to form (i) a top portion, (ii) a body portion, and (iii) a bottom portion. The top portion includes a neck and a fitment in the neck. The top portion includes a top handle. The top handle extends above the fitment. The top handle has a reciprocal attachment member. The bottom portion includes a bottom handle and a tether. The tether extends from the bottom handle. The tether includes a distal end that includes an attachment member. The attachment member is adapted to secure to the reciprocal attachment member.

Figure 3:
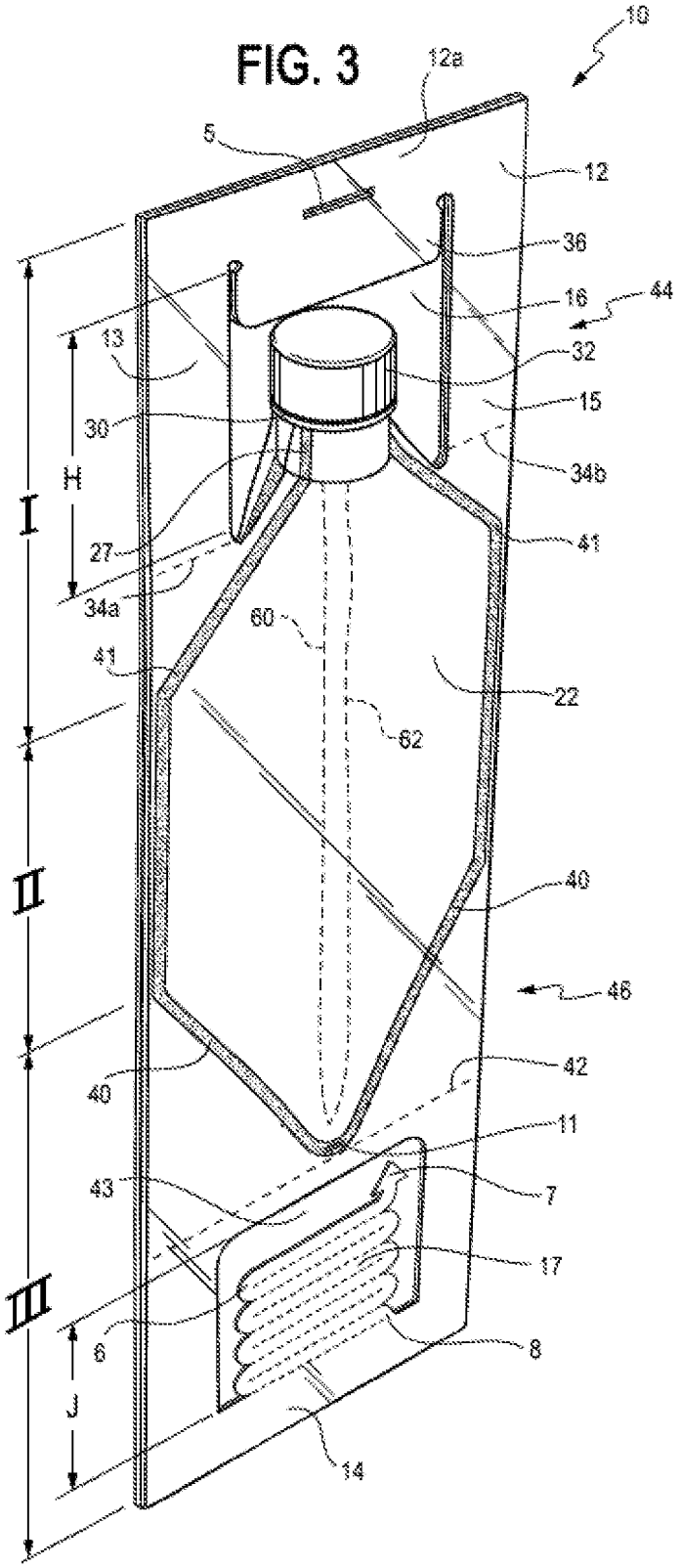
FIG. 3 is a perspective view of the flexible container of FIG. 1 in a collapsed configuration in accordance with an embodiment of the present disclosure.

FIGS. 1, 3-6 show a flexible container 10. The flexible container 10 has an expanded configuration (shown in FIGS. 1, 4-6) and has a collapsed configuration (shown in FIG. 3). The flexible container 10 has a top portion I, a body portion II, and a bottom portion III, as shown in FIG. 3.

The flexible container 10 has four panels. During the fabrication process, the panels are formed when one or more webs of film material are sealed together. In an embodiment, four webs of film material are sealed together to form the four panels. While the webs may be separate pieces of film material, it will be appreciated that any number of seams between the webs could be "pre-made," as by folding one or more of the source webs to create the effect of a seam or seams. For example, if it were desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bladder configuration).

Figure 2:
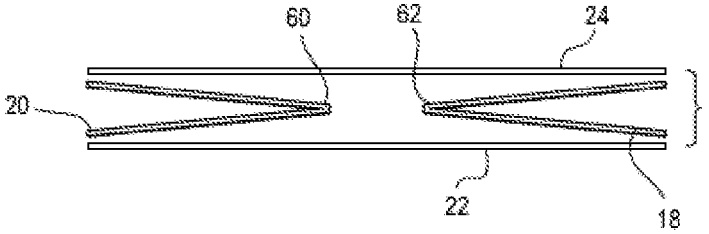
FIG. 2 is a side elevation view of a panel sandwich.

FIG. 2 shows the relative positions of the four webs as they form four panels (in a "one up" configuration) as they pass through the fabrication process. For clarity, the webs are shown as four individual panels, the panels separated and the seals not made. The constituent webs form a first gusseted side panel 18, a second gusseted side panel 20, a front panel 22 and a rear panel 24. Gusset fold lines 60 and 62 are shown in FIGS. 2 and 3.

As shown in FIG. 2, the folded gusseted side panels 18, 20 are placed between the rear panel 24 and the front panel 22 to form a "panel sandwich." The gusseted side panel 18 opposes the gusseted side panel 20. When the flexible container 10 is in the collapsed configuration, the flexible container is in a flattened state, or in an otherwise evacuated state. The gusseted side panels 18, 20 fold inwardly (dotted gusset fold lines 60, 62 of FIG. 3) and are sandwiched by the front panel 22 and the rear panel 24.

The four panels 18, 20, 22 and 24 each can be composed of a separate web of multilayer film. The composition and structure for each web of multilayer film can be the same or different. Alternatively, one web of multilayer film may also be used to make all four panels. In a further embodiment, two or more webs of multilayer film can be used to make each panel.

Multilayer Film

The flexible multilayer film used in construction of each panel of the flexible container 10 can comprise a food-grade plastic. For instance, nylon, polypropylene, polyethylene such as high density polyethylene (HDPE) and/or low density polyethylene (LDPE) may be used as discussed later. The flexible multilayer film can have a thickness that is adequate to maintain a flowable material and package integrity during manufacturing, distribution, product shelf life and customer usage. The film material can also be such that it provides the appropriate atmosphere within the flexible container 10 to maintain a product shelf life of at least about 180 days. The flexible multilayer film can comprise an oxygen barrier film having an oxygen transmission rate (OTR) that is reported in units of "cc/m$^2$/24 h/atm" and measured at 23° C. and 80% relative humidity (RH). In an embodiment, the flexible multilayer film has an OTR value from 0, or 0.2 to 0.4, or 1 cc/m$^2$/24 h/atm. In a further embodiment, the flexible multilayer film has an OTR value from 0 to 1, or from 0.2 to 0.4 cc/m$^2$/24 h/atm. Additionally, the flexible multilayer film can also comprise a water vapor barrier film having a water vapor transmission rate (WVTR) that is reported in units of "g/m$^2$/24 h" and measured at 38° C. and 90% RH. In an embodiment, the flexible multilayer film has a WVTR value from 0, or 0.2, or 1 to 5, or 10, or 15 g/m$^2$/24 h. In a further embodiment, the flexible multilayer film has a WVTR value from 0 to 15, or from 0.2 to 10, or from 1 to 5 g/m$^2$/24 h. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10.

In an embodiment, each panel 18, 20, 22, 24 is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

In an embodiment, the seal layer is a blend of an olefin-based polymer and a slip agent.

Nonlimiting examples of suitable olefin-based polymers for use in the seal layer blend include LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company)), propylene-based plastomers or elastomers such as VERSIFY™ (The Dow Chemical Company), and blends thereof.

A nonlimiting example of a suitable slip agent for use in the seal layer blend includes a fatty acid derivative. In an embodiment, the slip agent is an amide of a C18 to C24 fatty acid. In a further embodiment, the slip agent is an amide of a C22 mono-unsaturated fatty acid (e.g., erucamide)

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (BOPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN resins available from The Dow Chemical Company); vinylethylene vinyl alcohol (EVOH), metal foil (such as aluminum foil). Alternatively, modified polymeric films such as vapor deposited aluminum or silicon oxide on such films as BON, BOPET, or OPP, can be used to obtain barrier properties when used in laminate multilayer film.

In an embodiment, the flexible multilayer film has a thickness from 100 micrometers (μm), or 200 μm, or 250 μm to 300 μm, or 350 μm, or 400 μm. In a further embodiment, the flexible multilayer film has a thickness from 100 to 400 μm, or from 200 to 350 μm, or from 250 μm to 300 μm.

In an embodiment, the panels 18, 20, 22 and 24 are made of the same seven-layer film, with structure and composition set forth in Table 1 below.

TABLE 1

| Layer | Layer % | Layer composition |
|---|---|---|
| A | 10 | Dowlex 2038.68G (skin layer) |
| B | 15 | Innate ST50 |
| C | 15 | Innate ST50 |
| D | 10 | Innate ST50 |
| E | 15 | Innate ST50 |
| F | 15 | Innate ST50 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 2 below.

TABLE 2

| Layer | Layer % | Layer composition |
|---|---|---|
| A | 10 | Nylon 6/6,6 (skin layer) |
| B | 10 | Tie layer |
| C | 30 | Innate ST50 |
| D | 10 | Tie layer |
| E | 10 | Nylon 6/6,6 |
| F | 10 | Tie layer |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 3 below.

TABLE 3

| Layer | Layer % | Layer composition |
|---|---|---|
| A | 10 | Nylon 6/6,6 (skin layer) |
| B | 10 | Tie layer |
| C | 30 | Innate ST50 |
| D | 10 | Tie layer |
| E | 10 | EVOH |
| F | 10 | Tie layer |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

In an embodiment, the panels 18, 20, 22 and 24 are made of the same seven-layer film, with structure and composition set forth in Table 4 below.

TABLE 4

| Layer | Layer % | Layer composition |
|---|---|---|
| A | 15 | Elite 5960G1 (skin layer) |
| B | 15 | Innate ST50 |
| C | 10 | Innate ST50 |
| D | 10 | Innate ST50 |
| E | 15 | Innate ST50 |
| F | 15 | Elite 5960G1 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

Flexible Container

FIGS. 1, 4-6 show the flexible container 10 in the expanded configuration. The flexible container 10 has four panels 18, 20, 22 and 24. In an embodiment, the flexible container 10 includes one web of multilayer film for each respective panel 18, 20, 22, and 24. The gusseted side panels 18, 20 adjoin the front panel 22 and the rear panel 24 along peripheral seals 41 to form the body portion II, as shown in FIGS. 1 and 3. The peripheral seals 41 are located on the side edges of the flexible container 10. Four peripheral tapered seals 40 are located on the bottom portion III, as shown in FIGS. 1 and 3. An overseal 11 is formed where the four peripheral tapered seals 40 converge in a bottom segment 26, as shown in FIG. 3. The overseal 11 includes an area where a portion of each panel (18, 20, 22, 24) is sealed to a portion of every other panel to form a 4-ply seal. The overseal 11 also includes an area where two panels (front panel 22 and rear panel 24) are sealed together. The term "overseal," as used herein, is the area where the peripheral tapered seals 40 converge and that is subjected to at least two sealing procedures, as described herein.

The four panels 18, 20, 22, 24 extend toward a top end 44 to form the top portion I and extend toward a bottom end 46 to form the bottom portion III of the flexible container 10, as shown in FIGS. 1 and 3. The top portion I forms a top segment 28 and the bottom portion III forms the bottom segment 26. To form the top portion I and the bottom portion III, the four webs of film converge together at the respective end and are sealed together. For instance, the top segment 28 can be defined by four top panels that are extensions of the panels 18, 20, 22, 24 and are sealed together at the top end 44. The bottom segment 26 also can be defined by four bottom panels that are extensions of the panels 18, 20, 22, 24 and are sealed together at the bottom end 46. Nonlimiting examples of suitable methods for sealing the four webs of film together include ultrasonic sealing, heat sealing, impulse sealing, high frequency sealing, and combinations thereof. In an embodiment, the seal among the four webs of film is formed with a heat sealing procedure. The term "heat sealing procedure," as used herein, includes placing two or more films of polymeric material between opposing heat seal bars; moving the heat seal bars moved toward each other; sandwiching the films; and applying heat and pressure to the films such that opposing surfaces (seal layers) of the films contact, melt, and form a heat seal, or weld, to attach the films to each other. Heat sealing includes suitable structure and mechanism to move the seal bars toward and away from each other in order to perform the heat sealing procedure.

Top Portion

Top portion I includes a neck. In an embodiment, a portion of each of the four panels 18, 20, 22, 24 forms the top segment 28 and terminates at a neck 27, as shown in FIGS. 1 and 3. In this way, each panel extends from the bottom segment 26 to the neck 27. The neck 27 includes a fitment 30. At the neck 27, a portion of a top end section of each of the four panels 18, 20, 22, 24 is sealed, or otherwise is welded, to the fitment 30 to form a tight seal. In an embodiment, the fitment 30 is sealed to the neck 27 with the heat sealing procedure, as described herein. Although the base of fitment 30 has a circular cross-sectional shape, it is understood that the base of fitment 30 can have other cross-sectional shapes such as a polygonal cross-sectional shape, for example. The base with circular cross-sectional shape is distinct from fitments with canoe-shaped bases used for conventional two-panel flexible pouches.

In an embodiment, an outer surface of the base of fitment 30 has surface texture. The surface texture can include embossment and a plurality of radial ridges to promote sealing to the inner surface of the top segment 28.

In an embodiment, the fitment 30 is positioned at a midpoint of the top segment 28 and can be sized smaller than a width of the container 10, such that the fitment 30 can have an area that is less than a total area of the top segment 28. In a further embodiment, the fitment area is not more than 20% of the total top segment area. This can ensure that the fitment 30 will not be large enough to insert a hand therethrough, thus avoiding any unintentional contact with the flowable material 48 stored therein, as shown in FIGS. 1, 4-6.

In an embodiment, the fitment 30 is a spout. In a further embodiment, the fitment 30 is a threaded spout.

In an embodiment, the fitment 30 includes a closure. The closure covers the fitment 30 and prevents the flowable material 48 from spilling out of the container 10. The closure can be removable. Nonlimiting examples of a removable closure include a screw-on cap and flip-top cap. In an embodiment, the flexible container 10 includes the removable closure, a threaded cap 32, as shown in FIGS. 1 and 3.

Figure 4:
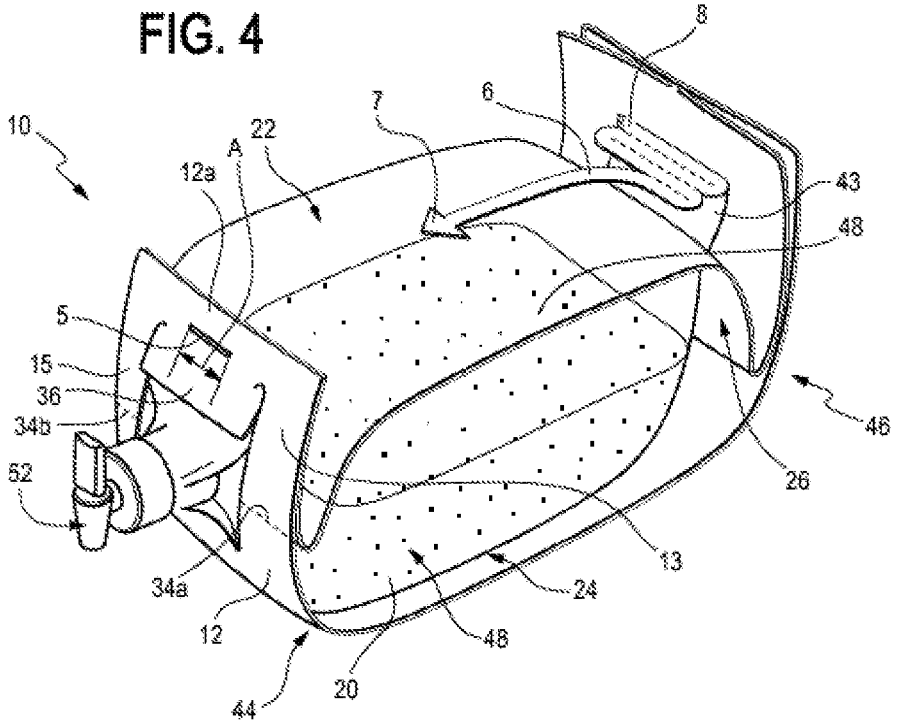
FIG. 4 is a perspective view of a flexible container with a dispensing spigot and actuation of the tether in accordance with an embodiment of the present disclosure.
Figure 5:
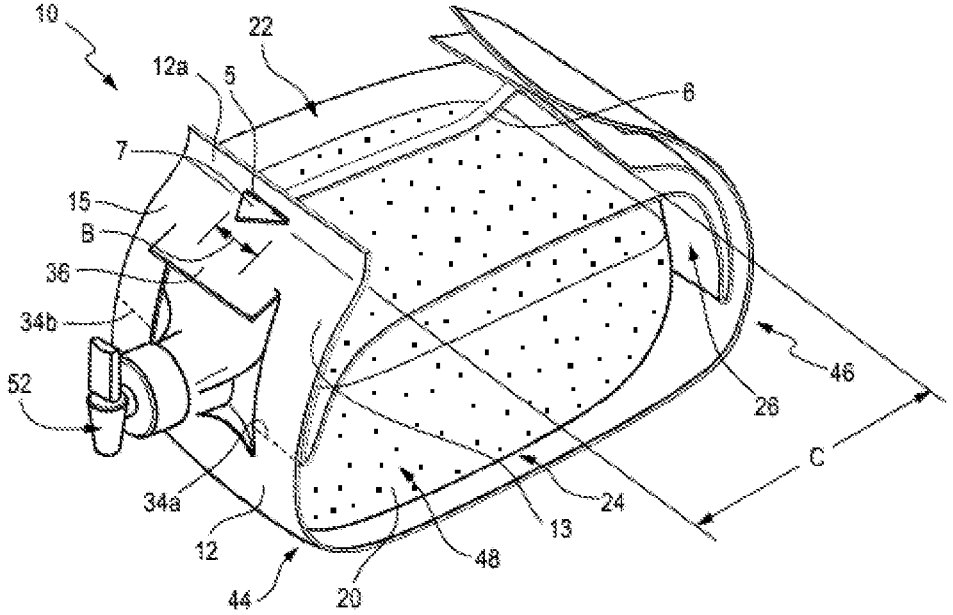
FIG. 5 is a perspective view of the flexible container of FIG. 4 with an attachment member of the tether secured to a reciprocal attachment member of a top handle in accordance with an embodiment of the present disclosure.
Figure 6:
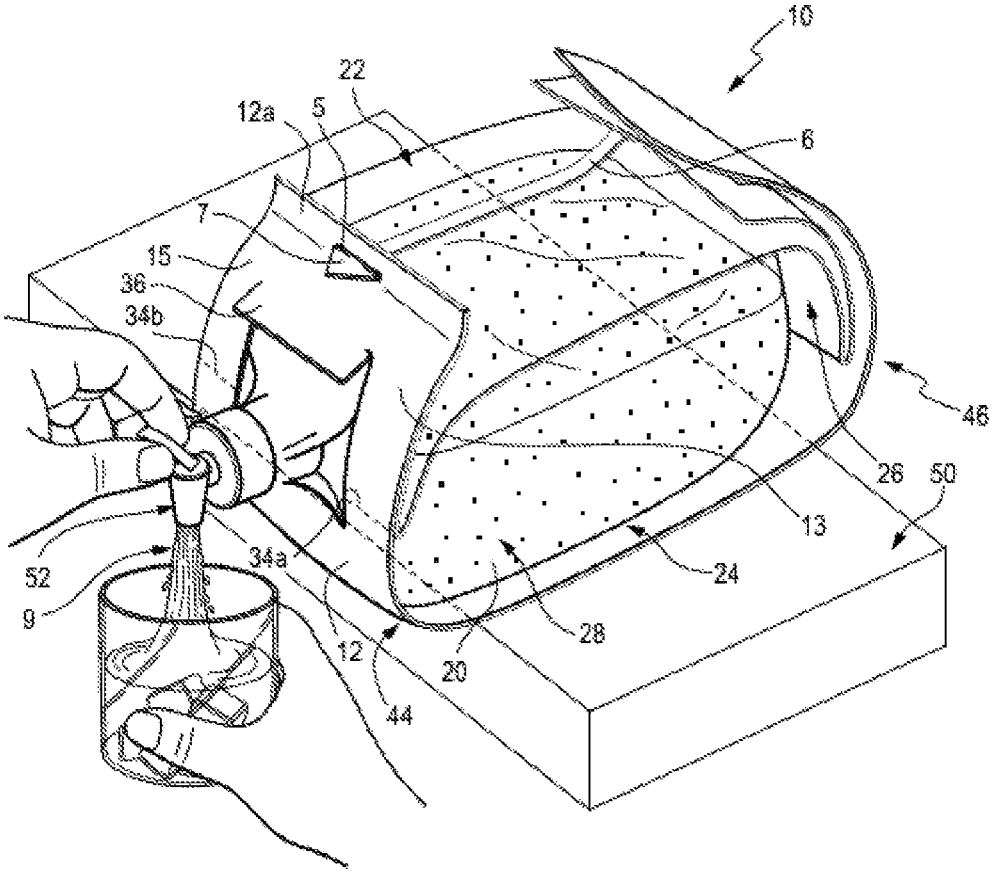
FIG. 6 is a perspective view of the flexible container of FIG. 5 dispensing a flowable material in accordance with an embodiment of the present disclosure.

In an embodiment, the fitment 30 is a dispensing fitment. A nonlimiting example of a dispensing fitment suitable for use includes a dispensing spigot. In an embodiment, the flexible container 10 includes the dispensing fitment, a spigot 52, as shown in FIGS. 4-6.

The fitment 30, the spigot 52, and the closure can be made of a rigid construction and can be formed of any appropriate plastic, such as high density polyethylene (HDPE), low density polyethylene (LDPE), polypropylene (PP), and combinations thereof. The location of fitment 30 (or spigot 52), can be anywhere on the top segment 28 of the container 10. In an embodiment, fitment 30 (or spigot 52), is located at the center or midpoint of the top segment 28.

The top portion I includes a top handle. As shown in FIGS. 1 and 3, a top handle 12 extends vertically, or substantially vertically, from the top segment 28 and, in particular, can extend from the four top panels that make up the top segment 28. The four top panels of film that extend into the top handle 12 are all sealed together to form a multi-layer top handle 12. In an embodiment, the four top panels of film are sealed together with the heat sealing procedure, as described herein. The top handle 12 can have a U-shape and, in particular, an upside down U-shape with an upper handle portion 12*a* having a pair of spaced legs 13 and 15 extending therefrom. The legs 13 and 15 extend from the top segment 28, adjacent the fitment 30 (or the spigot 52), with one leg 13 on one side of the fitment 30 and other leg 15 on the other side of the fitment 30 (or the spigot 52), with each leg 13, 15 extending from opposite portions of the top segment 28. The upper handle portion 12*a* extends horizontally, or substantially horizontally, between the legs 13 and 15.

A portion of the top handle 12 can extend above the fitment 30 (or the spigot 52), and above the top segment 28, and the entire upper handle portion 12*a* can be above the fitment 30 (or the spigot 52), and the top segment 28. The two pairs of legs 13 and 15 along with the upper handle portion 12*a* together make up the top handle 12 surrounding a top handle opening 16. The top handle opening 16 is sized to fit a user's hand. The top handle opening 16 can be any shape that is convenient to fit the hand and, in one aspect, the top handle opening 16 can have a generally oval shape. In another aspect, the top handle opening 16 can have a generally rectangular shape. Additionally, the top handle opening 16 of the top handle 12 can also have a flap 36 that comprises the cut material that forms the top handle opening 16, as shown in FIGS. 1, 3-6. To define the top handle opening 16, the top handle 12 can have a section that is cut out of the multilayer top handle 12 along three sides or portions while remaining attached at a fourth side or lower portion. This provides a flap of material 36 that can be pushed through the top handle opening 16 by the user and folded over an edge of the top handle opening 16. In an embodiment, the flap portion 36 folds upwards toward the upper handle portion 12*a* of the top handle 12 to create a smooth gripping surface of the top handle 12, such that the handle material is not sharp and can protect the user's hand from getting cut on any sharp edges of the top handle 12.

In an embodiment, top handle 12 can be "a punch-out handle," that is, a handle formed by a process that cuts, or otherwise "punches" film material from the flexible container 10, thereby removing film material from the flexible container 10. The punch-out handle does not have, or is otherwise void of, a flap.

As shown in FIG. 3, the top handle opening 16 has a height H. The height H of the top handle opening 16 is large enough to allow a bottommost edge of the upper handle portion 12*a* to clear an uppermost edge of the fitment 30 (or the spigot 52), as shown in FIGS. 1, 3-6. In an embodiment, the height H of the top handle opening 16 is from 4 centimeters (cm), or 6 cm, or 8 cm, or 10 cm, or 12 cm to 14 cm, or 16 cm, or 18 cm, or 20 cm. In a further embodiment, the height H of the top handle opening 16 is from 4 to 20 cm, or from 8 to 18 cm, or from 10 to 16 cm.

The top handle 12 is disposed in a position. Positions of the top handle 12 include a carry position and a retracted position. In an embodiment, top handle 12 has the carry position, as shown in FIGS. 1 and 3. The top handle 12 has the carry position when the flexible container 10 is grasped by a user at the top handle 12, for example. The user can ambulate with the flexible container 10 while the top handle 12 has the carry position.

In an embodiment, top handle 12 has the retracted position, as shown in FIGS. 4-6 and further described herein.

A portion of the top handle 12 attached to the top segment 28 can contain dead machine folds 34*a*-34*b*, or score lines, that provide for the top handle 12 to consistently fold in the same direction, as shown in FIGS. 1, 3-6. The machine folds 34*a*-34*b*, can comprise a fold line that permits folding in a first direction and restricts folding in a second direction. The terms "first direction," and "second direction," as used herein, are a direction toward the front side panel 22 and a direction toward the rear panel 24, respectively. The term "restricts," as used herein can mean that it is easier to move in the first direction than in the second direction. The two machine folds 34*a*-34*b* in the top handle 12 can allow for the top handle 12 to be inclined to fold or bend consistently in the first direction, rather than in the second direction. The machine fold 34*a*-34*b* can cause the top handle 12 to consistently fold in the first direction because it provides a generally permanent fold line in the handle that is predisposed to fold in the first direction, rather than in the second direction. The machine folds 34*a*-34*b* can be located in each leg 13, 15 at a location where the seal begins, as shown in FIGS. 1, 3-6. The top handle 12 can be adhered together, such as with a tack adhesive, beginning from the machine folded portions 34*a*-34*b* up to, and including, the upper handle portion 12*a* of the top handle 12. The positioning of the machine folds 34*a*-34*b* can be in the same latitude plane as the fitment 30 (or the spigot 52), and, in particular, at the bottommost portion of the fitment 30 (or the spigot 52). As will be discussed herein, the bottom handle 14 can also contain a machine fold 42 that also allows it to fold consistently in the same first direction as the top handle 12.

Body Portion

The body portion II of the flexible container 10 includes a chamber. A flowable material 48 is stored inside of the chamber, as shown in FIGS. 1, 4-6. The flowable material is a material that can be transferred into and out of the flexible container 10. The term "flowable material," as used herein, is a liquid or a particulate solid material that is pourable from the chamber, through the fitment 30, and out of the flexible container 10.

Numerous types of flowable materials can be stored within the chamber of the flexible container 10. The flowable material includes, but is not limited to, a solid material, a liquid material and a particulate material. In an embodiment, the flowable material 48 is a food product. Nonlimiting examples of food products suitable for storage within the chamber of the flexible container 10 include beverages such as water, juice, milk, syrup, carbonated beverages (beer, soft drinks), and fermented beverages (wine, scotch), salad dressings, sauces, dairy products, condiments (e.g., mayonnaise, mustard, ketchup) animal feed, and the like.

In an embodiment, the flowable material 48 is an industrial product. Nonlimiting examples of industrial products suitable for storage within the chamber of the flexible container 10 include oil, paint, grease, chemicals, cleaning solutions, washing fluids, suspensions of solids in liquid, and solid particulate matter (powders, grains, granular solids).

In an embodiment, the flowable material 48 is a squeezable product. The term "squeezable product," as used herein, is a flowable material (i) with a viscosity greater than the viscosity of water, and (ii) that requires application of a squeezing force to the flexible container 10 in order to discharge the material from the chamber. Nonlimiting examples of squeezable products suitable for storage within the chamber of the flexible container 10 include grease, butter, margarine, soap, shampoo, animal feed, sauces, baby food, and the like.

The chamber of the flexible container 10 has a volume. In an embodiment, the volume of the chamber of the flexible container 10 is from 0.25 liters (L), or 0.5 L, or 0.75 L, or 1 L, or 1.5 L, or 2.5 L, or 3 L, or 3.5 L, or 4 L, or 4.5 L, or 5 L to 6 L, or 7 L, or 8 L, or 9 L, or 10 L, or 20 L, or 30 L. In a further embodiment, the volume of the chamber of the flexible container 10 is from 0.25 to 30 L, or from 0.5 to 10 L, or from 3 to 8 L.

Bottom Portion

The bottom portion III includes a bottom handle 14, as shown in FIGS. 1 and 3. The bottom handle 14 can be positioned at the bottom end 46 of the flexible container 10 such that the bottom handle 14 is an extension of the bottom segment 26. The four bottom panels come together at a midpoint of the bottom segment 26 and are sealed together to form the bottom handle 14. In an embodiment, the four bottom panels are sealed together to form the bottom handle 14 with the heat sealing procedure, as described herein. The bottom handle 14 can comprise up to four layers of film (one layer for each panel 18, 20, 22, 24) sealed together when four webs of film are used to make the container 10. When more than four webs are used to make the container, the bottom handle 14 will include the same number of webs used to produce the container. Any portion of the bottom handle 14 where all four layers are not completely sealed together by the heat sealing procedure can be adhered together in any appropriate manner, such as by a tack seal to form a fully-sealed multi-layer bottom handle 14. The bottom handle 14 can have any suitable shape and generally will take the shape of the film end. For example, typically the web of film has a rectangular shape when unwound, such that its ends have a straight edge. Therefore, the bottom handle 14 would also have a rectangular shape.

The bottom handle 14 is disposed in a position. Positions of the bottom handle 14 include a storage position and a retracted position. The bottom handle 14 has the storage position when the flexible container 10 is being shipped, stored and displayed for sale, for example. The term "storage position," as used herein, is an orientation whereby the fitment/closure is the uppermost component of the flexible container 10. In other words, when the flexible container 10 is in the storage position, the flexible container 10 rests on the bottom end 46 (and on the bottom handle 14), when placed on a support surface.

In an embodiment, the bottom handle 14 has the retracted position, as shown in FIGS. 4-6 and further described herein.

As with the top handle 12, the bottom handle 14 also can have a dead machine fold 42, as shown in FIGS. 1 and 3, that permits folding in the first direction toward the front side panel 22 and restricts folding in the second direction toward the rear panel 24. The machine fold 42 can allow for the bottom handle 14 to be inclined to fold or bend consistently toward the top handle 12 in the first direction, rather than in the second direction. When the flexible container 10 is stored in the storage position, the machine fold 42 of bottom handle 14 encourages the bottom handle 14 to fold in the first direction along the machine fold 42, such that the bottom handle 14 can fold underneath the container 10. The weight of the flowable material 48 can also apply a force to the bottom handle 14, such that the weight of the flowable material 48 can further press on the bottom handle 14 and maintain the bottom handle 14 in the folded position in the first direction.

Tether

The flexible container 10 includes a tether. In an embodiment, the tether is connected to, and extends from, the top handle 12. In a further embodiment, the tether is connected to, and extends from, the bottom handle 14.

In an embodiment, a tether 6 is located inside a bottom handle opening 43 that is surrounded by the bottom handle 14, as shown in FIGS. 1 and 3. The bottom handle opening 43 has a height J. The height J of the bottom handle opening 43 is large enough to contain the tether 6, as shown in FIGS. 1 and 3. In an embodiment, the height J of the bottom handle opening 43 is from 4 centimeters (cm), or 6 cm, or 8 cm, or 10 cm, or 12 cm to 14 cm, or 16 cm, or 18 cm, or 20 cm. In a further embodiment, the height J of the bottom handle opening 43 from 4 to 20 cm, or from 8 to 18 cm, or from 10 to 16 cm.

In an embodiment, tether 6 is connected to bottom handle 14 by way of integral construction. In other words, tether 6 is integral with the bottom handle 14. The term "integral" or "integral construction," as used herein, refers to two components that are constructed from the same web(s) of multilayer film, e.g., the tether 6 is constructed from the same four webs of multilayer film (one layer for each panel 18, 20, 22, 24) that are sealed together to provide the bottom handle 14. The tether 6 includes a proximate end 8 that is attached to the bottom handle 14. The tether 6 includes an attachment member 7 that is located at a distal end of the tether 6, as shown in FIGS. 1, 3-6. The attachment member 7 is adapted to secure to a reciprocal attachment member 5 located in the top handle 12 of the flexible container 10, as shown in FIGS. 1, 3-6. In an embodiment, the reciprocal attachment member 5 is located in the center of the upper handle portion 12*a*.

In an embodiment, the tether 6 includes a body that extends from the proximate end 8 of the tether 6 to the attachment member 7 at the distal end of the tether 6. The body of the tether 6 is non-rigid and can move freely when the attachment member 7 is extended from the bottom handle 14.

In an embodiment, the tether 6 includes perforations 17, as shown in FIGS. 1 and 3. The perforations 17 facilitate extension of the tether 6 from the bottom handle 14. The perforations 17 can be formed by a machine or can be formed manually. In an embodiment, the perforations 17 of the tether 6 are formed by a machine.

In an embodiment, flexible container 10 includes a free tether. The term "free tether," is a tether that is not integral to the flexible container 10, the free tether being a separate and distinct component of the flexible container 10. The free tether includes a securement member for securing to the flexible container 10. The securement member may releasably secure, or permanently secure, a proximate end of the free tether to the flexible container 10. The free tether includes an attachment member (at a distal end) and a body that extends between the proximate end and the attachment member of the free tether. The body of the free tether has a length sufficient to extend between the bottom handle 14 and the top handle 12. In an embodiment, the free tether is attached to the bottom handle 14 after the flexible container 10 is produced, for example. Nonlimiting examples of suitable free tethers include elastic band or strap, plastic band or strap, string, metal band or strap, synthetic and/or natural rubber band or strap, spring, and combinations thereof.

As shown in FIGS. 5-6, the attachment member 7 of the tether 6 is secured to the reciprocal attachment member 5 of the top handle 12. In an embodiment, the attachment member 7 can be an inserting fastening component (i.e., male) and the reciprocal attachment member 5 can be an accepting fastening component (i.e., female). In a further embodiment, the attachment member 7 can be an accepting fastening component (i.e., female) and the reciprocal attachment member 5 can be an inserting fastening component (i.e., male).

In an embodiment, the attachment member 7 and the reciprocal attachment member 5 are a matched pair of interlocking fasteners. Nonlimiting examples of suitable matched pair interlocking fasteners include a cable tie (e.g., wire tie, hose tie, steggel tie, zap strap, zip tie), clips (e.g., hairpin clip, terry clip), a hook-and-eye closure, a hook and loop fastener (velcro), snap fasteners (i.e., interlocking disks), a threaded insert (e.g., nut and bolt), button/button hole fastener, and combinations thereof. In a further embodiment, each of the attachment member 7 and the reciprocal attachment member 5 are interlocking fasteners that can be twisted together, or otherwise intertwined, to form a secure connection, or a releasably secure connection. A nonlimiting example of a suitable fastener includes a twist tie.

In an embodiment, the reciprocal attachment member 5 is a horizontal opening that is located in the center of the upper handle portion 12*a* of the top handle 12, as shown in FIGS. 1, 3-4. The reciprocal attachment member 5 is characterized by a width A that is the longest dimension of the reciprocal attachment member 5, as shown in FIG. 4. In an embodiment, the width A of the reciprocal attachment member 5 is from 5 millimeters (mm), or 8 mm, or 10 mm, or 12 mm, or 14 mm to 16 mm, or 18 mm, or 20 mm , or 23 mm, or 30 mm, or 40 mm. In a further embodiment, the width A of the reciprocal attachment member 5 is from 5 to 40 mm, or from 10 to 30 mm, or from 12 to 18 mm.

In an embodiment, the attachment member 7 is a fastening member. Nonlimiting examples of fasteners suitable as the fastening member include a buckle, a button, and a clasp (e.g., a lobster clasp). In a further embodiment, the attachment member 7 is integral with the tether, i.e., the attachment member 7 is constructed from the same web of multilayer film that provides the tether 6. The shape of the attachment member 7 is adapted to secure the attachment member 7 to the reciprocal attachment member 5 when the attachment member 7 is inserted into the reciprocal attachment member 5. Nonlimiting examples of suitable shapes for the attachment member 7 include triangular, rectangular, and trapezoidal. In an embodiment, the attachment member 7 has a triangular shape, as shown in FIGS. 1, 3-6. The attachment member 7 is characterized by a width B that is the longest dimension of the attachment member 7, as shown in FIG. 5. Width B is greater than width A so that when attachment member 7 is fully inserted into reciprocal attachment member 5, the rear portion of attachment member 7 abuts against, and extends past, reciprocal attachment member 5 securely engaging with the film of the top handle surrounding the reciprocal attachment member 5, as shown in FIGS. 5-6. When attachment member 7 is fully inserted into and through reciprocal attachment member 5, the abutment of a rear portion of the attachment member 7 with the reciprocal attachment member 5 locks attachment member 7 in place, fastening tether 6 to the top handle 12.

In an embodiment, the width B of the attachment member 7 is greater than width A of the reciprocal attachment member 5. In an embodiment, width B is from 4 mm, or 7 mm, or 9 mm, or 11 mm, or 13 mm to 15 mm, or 17 mm, or 19 mm, or 22 mm, or 29 mm, or 39 mm. In a further embodiment, the width B of the attachment member 7 is from 4 to 39 mm, or from 9 to 29 mm, or from 11 to 17 mm.

In an embodiment, the attachment member 7 is a plurality of teeth disposed in a linear arrangement along the length of the tether 6 and the reciprocal attachment member 5 is a pawl. The term "pawl," as used herein, is a component that engages the teeth of the tether 6 to prevent movement in one direction, or prevent movement altogether. The pawl can engage the teeth of the tether 6 at a steep angle. As the tether and the teeth are inserted into the pawl, a ratchet forms between the teeth of the tether and the pawl. The nascent ratchet secures the reciprocal attachment member 5 to the attachment member 7. In an embodiment, the pawl of the reciprocal attachment member 5 includes a tab that can be depressed to release the teeth of the tether 6 so that the tether 6 can be loosened, removed, or reinserted.

In an embodiment, the attachment member is an insertion hole at the distal end of the tether 6. The insertion hole is reinforced and fashioned to accept, and secure, a fastener. Nonlimiting examples of fasteners suitable for use include a pin, such as a bowtie cotter pin, a cotter pin, a dowel, and a linchpin, for example. To secure the attachment member to the reciprocal attachment member 5, the tether 6 is placed through the reciprocal attachment member 5 and the fastener is inserted into the insertion hole of the attachment member.

The tether 6 is disposed in a configuration that can be a stowed configuration and an extended configuration. In an embodiment, the tether 6 has the stowed configuration as shown in FIGS. 1 and 3. The term "stowed," as used herein, is the tether contained within the bottom handle opening 43 and not extended from the bottom handle 14. The tether 6 has the stowed configuration when the flexible container 10 is being shipped, stored and displayed for sale, for example. The tether 6 has a shape when the tether 6 has the stowed configuration. Nonlimiting examples of suitable shapes of the tether 6 in the stowed configuration include serpentine, coiled, folded, stacked, compressed, and twisted. In an embodiment, the tether 6 has the serpentine shape in the stowed configuration, as shown in FIGS. 1 and 3. In a further embodiment, the tether 6 has the coiled shape in the stowed configuration.

FIG. 4 shows the tether 6 exiting the stowed configuration and being extended from the bottom handle 14. When the attachment member 7 is secured to the reciprocal attachment member 5 of the top handle 12, the tether 6 moves from the stowed configuration to the extended configuration and the tether 6 is extended completely, or substantially completely, as shown in FIGS. 5-6. When attachment member 7 is fully inserted into and through the reciprocal attachment member 5 (as previously disclosed), the top handle 12 moves from the carry position to the retracted position and the bottom handle 14 also moves to the retracted position when the attachment member 7 is secured to the reciprocal attachment member 5, as shown in FIGS. 4-6. The machine folds 34*a*-34*b* and 42 easily bend in the first direction toward the front panel 22 and facilitate movement of attachment member 7 toward reciprocal attachment member 5 and facilitate movement of top handle 12 and bottom handle 14 into their retracted positions. The facile bend of the machine folds 34*a*-34*b* and 42 reduces tension within the flexible container 10 while the attachment member 7 is secured to reciprocal attachment member 5. The reduced tension increases the stability of the flexible container 10 while the top handle 12 and the bottom handle 14 are in their retracted positions.

The tether 6 has a resting length when the tether 6 has the extended configuration, as shown in FIGS. 5 and 6. The term "resting length," as used herein, is the distance from the bottom handle 14 to the reciprocal attachment member 5 when (i) the reciprocal attachment member 5 is secured to the attachment member 7 and (ii) the top handle 12 and the bottom handle 14 are in their retracted positions. In an embodiment, the resting length of the tether 6 is non-adjustable and is a discrete length. In a further embodiment, the resting length of the tether 6 is adjustable and can attain two or more values.

The term "adjustable tether," as used herein, is a tether having an adjustable resting length. An adjustable tether is a modified form of the tether 6. In an embodiment, the adjustable tether includes two or more triangular shaped attachment members disposed in a linear arrangement along the length of the adjustable tether. In this embodiment, the reciprocal attachment member 5 is the horizontal shaped opening located in the center of the upper handle portion 12*a* of the top handle 12, as shown in FIGS. 1 and 3. The adjustable tether includes a plurality of teeth disposed in a linear arrangement along the length of the adjustable tether and the reciprocal attachment member 5 is a pawl.

The resting length of the tether 6 is characterized by a length C, as shown in FIG. 5. In an embodiment, the resting length of the tether 6 is from 5 cm, or 8 cm, or 10 cm, or 12 cm, or 15 cm, or 18 cm, or 20 cm, or 22 cm to 28 cm, or 30 cm, or 35 cm, or 40 cm, or 50 cm, or 60 cm, or 70 cm. In a further embodiment, the resting length of the tether 6 is from 5 to 70 cm, or from 15 to 40 cm, or from 20 to 30 cm.

Process

The present disclosure provides a process. The process includes providing a flexible container. The flexible container includes a front panel, a rear panel, a first gusseted side panel, and a second gusseted side panel. The gusseted side panels adjoin the front panel and the rear panel along peripheral seals to form (i) a top portion, (ii) a body portion, and (iii) a bottom portion. The top portion includes a top handle, and a neck, the neck having a fitment. The top handle extends above the fitment. The top handle has a reciprocal attachment member. The bottom portion includes a bottom handle and a tether. The tether extends from the bottom handle. The tether includes a distal end that includes an attachment member. The attachment member is adapted to secure to the reciprocal attachment member. The process includes securing the attachment member to the reciprocal attachment member.

The process includes retracting the top handle 12 of the flexible container 10 with the tether 6. In an embodiment, the tether 6 is extended from the bottom handle 14, as shown in FIGS. 4-6. As the tether 6 is extended, the attachment member 7 moves towards top handle 12, and, simultaneously, away from bottom handle 14. The attachment member 7 is secured to the reciprocal attachment member 5 of top handle 12. The top handle 12 moves from the carry position to the retracted position when the attachment member 7 is secured to the reciprocal attachment member 5.

The process includes placing the rear panel (or front panel), on a support surface. Prior to dispensing the flowable material 48 from the chamber of the flexible container 10, the flexible container 10 is placed on a support surface 50, as shown in FIG. 6. In an embodiment, the rear panel 24 of the flexible container 10 is placed on, and adjacent to, the support surface 50. Although FIG. 6 shows rear panel 24 resting on the support surface 50, it is understood that the tether 6 may be deployed such that the front panel 22 rests on the support surface 50.

The process includes dispensing the flowable material from the chamber and through the fitment. The user operates the spigot 52 while holding a receiving container (e.g., a glass), as shown in FIG. 6. The flowable material 48 dispenses from the chamber of the flexible container 10 and through the spigot 52 as a flowing material 9. While in the retracted position, the top handle 12 remains in an area away from the spigot 52. In this manner, the top handle 12 does not interfere with the dispensing of flowing material 9 from the chamber, as shown in FIG. 6.

As the flexible container 10 is evacuated and less flowable material 48 remains, the resting length of the adjustable tether can be shortened. The shortened length of the adjustable tether can facilitate the movement and settling of the flowable material 48 toward the spigot 52.

By way of example, and not by limitation, some embodiments of the disclosure will now be described in detail in the following Examples.

EXAMPLES

The raw materials used to prepare the individual film layers of the multilayer films are provided in Table 5 below.

TABLE 5

| Polymer | Melt Index | Density | Supplier |
|---|---|---|---|
| Dowlex 2038.68G | 1.0 | 0.935 | Dow Inc. |
| Innate ST50 | 0.85 | 0.918 | Dow Inc. |
| Affinity 1146G | 1.0 | 0.899 | Dow Inc. |
| Antiblock | NA | NA | Ampacet |
| 20% silica, 80% LDPE | | | |
| Erucamide | NA | NA | Ampacet |
| 5% Slip, 95% LDPE | | | |
| Ultramid ® C33 | | | BASF |
| (Nylon 6/66) | | | |
| Tie Layer | Blend = 0.95 | TY | Dow Inc. |
| 15% Amplify TY 1057H | TY 1057H = 3.0 | 1057H = 0.912 | |
| 85% Innate ST50 | ST50 = 0.85 | | |
| EVOH EVAL H171B | 1.7 | 1.17 | Kuraray |
| Elite 5960G1 | 0.85 | 0.962 | Dow Inc. |

The structure of Film 1 used to produce the flexible containers is provided in Table 6 below.

TABLE 6

| Layer | Layer % | Layer composition |
|---|---|---|
| A | 10 | Dowlex 2038.68G (skin layer) |
| B | 15 | Innate ST50 |
| C | 15 | Innate ST50 |

TABLE 6-continued

| Layer | Layer % | Layer composition |
|---|---|---|
| D | 10 | Innate ST50 |
| E | 15 | Innate ST50 |
| F | 15 | Innate ST50 |
| G | 20 | 95% Affinity 1146G + 4% Antiblock (20% silica + 80% LDPE) + 1% Erucamide (5% Slip + 95% LDPE) (seal layer) |
| Total | 100 | |

The total thickness of the seven-layer film is 200 microns

The multilayer film is fabricated using a 7-layer Alpine blown film line and has an A/B/C/D/E/F/G structure. Layer "A" is the outer (i.e., skin) layer and layer "G" is the seal layer.

The "Layer %" value in Table 6 is the proportion of each layer in the multilayer film. The thickness of each layer is determined by multiplying the "Layer %" value by the total thickness of the multilayer film.

The total thickness of the multilayer film is 200 microns.

The 7-layer film of Table 6 is used to produce a four panel flexible container 10 with a tether and reciprocal attachment member shown in FIGS. 1, 4-6.

It is specifically intended that the present disclosure not be limited to the embodiments and illustrations contained herein, but include modified forms of those embodiments including portions of the embodiments and combinations of elements of different embodiments as come with the scope of the following claims.

What is claimed is:

1. A flexible container comprising:

a front panel, a rear panel, a first gusseted side panel, and a second gusseted side panel, the gusseted side panels adjoining the front panel and the rear panel along peripheral seals to form (i) a top portion, the top portion comprising a neck and a fitment in the neck, (ii) a body portion, and (iii) a bottom portion;

the top portion comprising a top handle extending above the fitment, the top handle having a reciprocal attachment member;

the bottom portion comprising a bottom handle; and a tether extending from the bottom handle, a distal end of the tether having an attachment member, the attachment member adapted to secure to the reciprocal attachment member.

2. The flexible container of claim 1 wherein the tether has a stowed configuration; and the tether has a coiled shape in the stowed configuration.

3. The flexible container of claim 1 wherein the top handle has a carry position; and the top handle moves from the carry position to a retracted position when the attachment member is secured to the reciprocal attachment member.

4. The flexible container of claim 1 wherein the tether is integral to the bottom handle.

5. The flexible container of claim 1 wherein the attachment member has a triangular shape and the reciprocal attachment member is a horizontal shaped opening located in the top handle.

6. The flexible container of claim 1 wherein each panel is a flexible multilayer film.

7. A process comprising:

providing a flexible container comprising a front panel, a rear panel, a first gusseted side panel, and a second gusseted side panel, the gusseted side panels adjoining the front panel and the rear panel along peripheral seals to form (i) a top portion, the top portion comprising a neck and a fitment in the neck, (ii) a body portion, and (iii) a bottom portion, the top portion comprising a top handle extending above the fitment, the top handle having a reciprocal attachment member, the bottom portion comprising a bottom handle, and a tether extending from the bottom handle, a distal end of the tether having an attachment member; and securing the attachment member to the reciprocal attachment member.

8. The process of claim 7 comprising retracting, with the securing, the top handle.

9. The process of claim 8 wherein the body portion comprises a chamber and a flowable material is in the chamber, the process comprising placing the rear panel on a support surface; and dispensing the flowable material from the chamber and through the fitment.

* * * * *